United States Patent [19]

Nonaka et al.

[11] 4,007,395

[45] Feb. 8, 1977

[54] TARGET STRUCTURE FOR USE IN PHOTOCONDUCTIVE IMAGE PICKUP TUBES

[75] Inventors: Yasuhiko Nonaka, Mobara; Naohiro Goto, Machida; Keiichi Shidara, Tama, all of Japan

[73] Assignees: Hitachi, Ltd.; Nippon Hoso Kyokai, both of Tokyo, Japan

[22] Filed: May 23, 1975

[21] Appl. No.: 580,473

[30] Foreign Application Priority Data

June 21, 1974 Japan ..... 49-70214

[52] U.S. Cl. ..... 313/386; 313/94

[51] Int. Cl.[2] ..... H01J 29/45; H01J 31/38

[58] Field of Search ..... 313/94, 366, 384, 385, 313/386

[56] References Cited

UNITED STATES PATENTS

| | | | |
|---|---|---|---|
| 3,800,194 | 3/1974 | Maruyama et al. | 313/366 X |
| 3,890,524 | 6/1975 | Watanabe et al. | 313/94 X |
| 3,890,525 | 6/1975 | Hirai et al. | 313/94 X |
| 3,922,579 | 11/1975 | Goto et al. | 313/94 X |

*Primary Examiner*—Robert Segal
*Attorney, Agent, or Firm*—Charles E. Pfund

[57] ABSTRACT

In a method of manufacturing a target structure for use in a photoconductive image pickup tube when depositing a P-type photoconductive film on an N-type transparent conductive film deposited on one side of a transparent substrate which acts as an incident window of the image pickup tube, the P-type photoconductive film is made up of first and second photoconductive substances. The commencement of the deposition of the first photoconductive substance is delayed a predetermined time than that of the second photoconductive substance and the deposition of the first photoconductive substance is terminated before completion of the deposition of the second photoconductive material thereby forming a layer of the first photoconductive substance not contiguous to the junction between the N-type transparent conductive film and the P-type photoconductive film and having a predetermined thickness.

14 Claims, 11 Drawing Figures

TARGET STRUCTURE FOR USE IN PHOTOCONDUCTIVE IMAGE PICKUP TUBES

BACKGROUND OF THE INVENTION

This invention relates to the target structure of a photoconductive image pickup tube and more particularly to the target structure of a photoconductive image pickup tube having a heterogeneous junction capable of manifesting improved operating characteristics and a method of manufacturing such a target structure.

As an image pickup tube including a target which utilizes a non-crystalline photoconductive film, a vidicon has been known which includes an ohmic junction utilizing a film of antimony trisulfide.

Recently, an image pickup tube including a photoconductive target which utilizes a non-crystalline photoconductive film wherein use is made of a heterogeneous junction between a P-type photoconductive film containing selenium and an intensifier such as tellurium and an N-type conductive film such as Nesa film has been proposed.

The image pickup tube of this type is characterized in that it has a wide range of spectrum sensitivity, a fast response time, low dark current and a high resolution and that it is easy to manufacture.

Typically, the target structure of the image pickup tube having these characteristics is constructed such that a transparent conductive film consisting essentially of indium oxide or stannic oxide having N-type conductivity is coated on the rear surface of a glass substrate or a transparent glass window that transmits the incident rays to the image pickup tube and that a P-type photoconductive film comprising selenium, less than 30 atomic % of tellurium and less than 30 atomic % of arsenic, for example, a P-type photoconductive film comprising a mixture of a first photoconductive substance consisting of selenium and 40 atomic % of tellurium and a second photoconductive substance consisting of selenium and 10 atomic % of arsenic is deposited on the rear surface of the N-type transparent conductive film through a heterogeneous junction surface. According to another type, an N-type transparent semiconductive film is formed on the rear surface of said N-type transparent conductive film by the vapour deposition of cadmium selenide, cadmium sulfide, zinc sulfide, gallium arsenic, germanium or silicon and said P-type photoconductive film is formed on the rear surface of the N-type transparent semiconductive film through a heterogeneous junction surface. Furthermore, for the purpose of improving the landing characteristic of an electron beam emitted from an electron beam emitting device on the photoconductive film a porous film of antimony trisulfide ($Sb_2S_3$) is formed on the rear surface of the P-type photoconductive film. In these cases, as will be described later with reference to the accompanying drawings the tellurium in the first photoconductive substance presents throughout the thickness of the P-type photoconductive film and the concentration of the tellurium increases substantially continuously from the heterogeneous junction surface whereas the concentration of the arsenic in the second photoconductive substance is substantially uniform from the heterogeneous junction surface to the P-type photoconductive film and throughout the thickness thereof. Although the purpose of tellurium is to improve the light absorption characteristic it has a larger tendency of crystallization under heat than selenium, so that much quantity of tellurium enhances the crystallization of the P-type photoconductive film thus causing local decrease in the film resistance. This results in the defects of the picture picked up in the form of white spots, thus greatly decreasing the quality of the picture.

With this construction, the region in which the concentration of tellurium is high and hence having an extremely low specific resistance is located close to the heterogeneous junction surface so that the heterogeneous junction is deteriorated and the initial dark current characteristic is greatly impaired. Where the target is stored or left standstill in atmosphere at a temperature of higher than 60° C the heterogeneous junction surface is deteriorated to increase the dark current due to a slight diffusion of tellurium. Such variation in the dark current characteristic causes a poor colour balance of the picture picked up by the image pickup tube thus degrading the quality of the picture.

SUMMARY OF THE INVENTION

It is an object of this invention to provide a photoconductive target for an image pickup tube having a high spectrum sensitivity characteristic over a wide range of the wavelength and an improved thermal characteristic.

Another object of this invention is to provide an improved target structure for an image pickup tube having a stable and small dark current characteristic.

Still another object of this invention is to provide a photoconductive target for an image pickup tube which can operate under low operating voltages.

According to one aspect of this invention, there is provided a target structure for use in a photoconductive image pickup tube of the type comprising a transparent substrate, an N-type transparent conductive film deposited on the rear side of the substrate, and a P-type photoconductive film deposited on the rear side of the N-type transparent conductive film via a heterogeneous junction surface and containing selenium as an intensifier, characterized in that the thickness of the intensifier containing portion of the P-type photoconductive film is made to be within a predetermined range smaller than the total thickness of the P-type photoconductive film and that the starting point of the intensifier containing portion is positioned in a prescribed range as measured in the direction of the thickness of the P-type photoconductive film from the heterogeneous junction surface between the P-type photoconductive film and the N-type conductive layer.

According to another aspect of this invention there is provided a method of manufacturing a target structure for use in a photoconductive image pickup tube, characterized by the steps of preparing a transparent substrate, depositing an N-type transparent conductive film on one surface of the substrate, depositing at a substantially constant speed on the N-type conductive film a second photoconductive substance which constitutes a P-type photoconductive film, commencing the deposition at a continuously varying speed of a first photoconductive substance which constitutes the P-type photoconductive film at a time later than the commencement of the deposition of the second photoconductive substance while the second photoconductive substance is being deposited, and terminating the deposition of the first photoconductive substance before completion of the deposition of the second photoconductive substance.

The N-type transparent conductive film comprises indium oxide, stannic oxide, mixture of indium oxide with stannic oxide, or mixture of stannic oxide with antimony.

The P-type photoconductive film comprises a first photoconductive substance consisting of selenium containing tellurium and a second photoconductive substance consisting of selenium containing arsenic.

Preferably the P-type photoconductive film has the content of selenium, less than 30 atomic % tellurium and less than 30 atomic % arsenic. The concentration distribution of arsenic is substantially uniform over the entire thickness of the P-type photoconductive film whereas the concentration of tellurium is localized near the heterogeneous junction surface.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

Figure 1A:
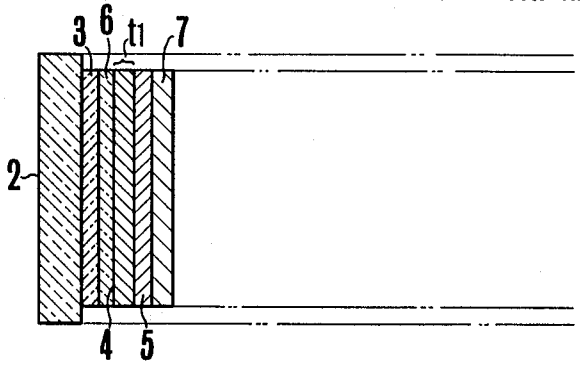
FIG.1A' PRIOR ART
FIGS. 1A and 1A' are diagrammatic representations showing the constructions of the prior art target structures for use in photoconductive image pickup tubes.

As diagrammatically shown by FIG. 1A, a prior art target generally designated by a reference numeral 1 and used in a photoconductive image pickup tube comprises a transparent substrate 2 sealed to the front surface of the pickup tube, not shown. An N-type transparent conductive film 3 is provided for the rear surface of the substrate 2 and a P-type photoconductive film 5 is formed on the back of the film 3. A heterogeneous junction surface 4 is formed between the N-type transparent conductive film 3 and the P-type photoconductive film 5. The N-type transparent conductive film 3 comprises indium oxide, stannic oxide, mixture of indium oxide with stannic oxide, or mixture of stannic oxide with antimony. The P-type photoconductive film 5 preferably comprises selenium, less than 30 atomic % tellurium and less than 30 atomic % arsenic.

Figure 1A:
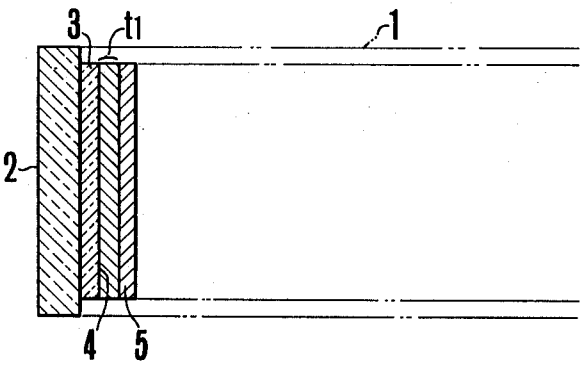
FIG.1A PRIOR ART
Figure 1B:
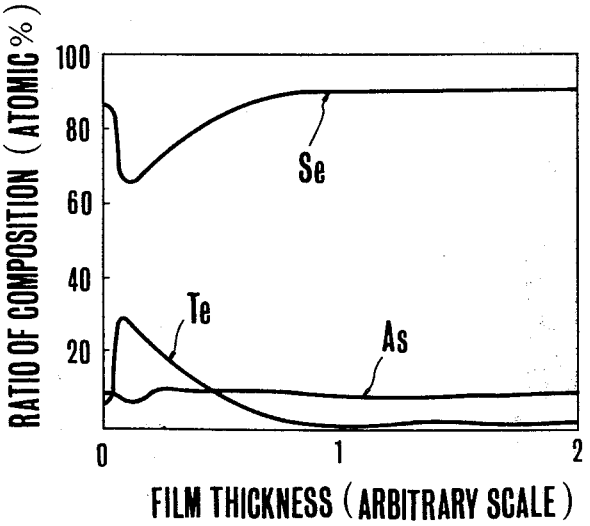
FIG. 1B is a graph showing the distribution of the composition of the P-type photoconductive film utilized in the target structures shown in FIGS. 1A and 1A'.

Another prior art target structure shown in FIG. 1A' comprises the transparent substrate 2, N-type transparent conductive film 3 formed on the back of the substrate 2, an N-type transparent semiconductive film 6 formed on the back of the N-type transparent conductive film 3 and comprising an element selected from the group consisting of cadmium selenide, cadmium sulfide, zinc sulfide, gallium arsenic, germanium and silicon, P-type photoconductive film 5 on the back of the N-type transparent semiconductive film 6 and a semiporous film 7 of antimony trisulfide $Sb_2S_3$ on the rear side of the P-type photoconductive film 5. The N-type transparent semiconductive film 6 contributes to reduction of the dark current during operation and reduction of the white spot. The semiporous film 7, as mentioned previously, contributes to improvement in the landing characteristic of electron beams. Although not illustrated, simple modifications are possible wherein the semi-porous film 7 is incorporated into the target structures shown in FIGS. 1A and 2A in the same manner as FIGS. 1A' and 2A'. A heterogeneous junction surface 4 is formed at the interface between the N-type transparent semiconductive film 6 and the P-type photoconductive film 5. The P-type photoconductive film 5 comprises a mixture of a first photoconductive substance consisting of selenium and 40 atomic % of tellurium and a second photoconductive substance consisting of selenium and 10 atomic % of arsenic for example. However, the tellurium is not uniformly distributed throughout the thickness but concentrates in a layer having a thickness of $t_1$. More particularly, as shown in FIG. 1B, although the tellurium distributes throughout the thickness, the concentration of tellurium is the highest in region $t_1$ shown in FIG. 1A. More noticeable is the fact that the region $t_1$ is contiguous to the heterogeneous junction surface 4. For this reason, the prior art target structures had a number of difficulties as has been pointed out in the foregoing description.

According to one example of the prior art methods of manufacturing the target of an image pickup tube provided with a heterogeneous junction of the construction described above, the transparent conductive film of indium oxide, for example, having N-type conductivity is formed on the transparent substrate 2. Then the first and second photoconductive substances are prepared independently and pulverized. Then, the powders thereof are put in separate tantalum evaporation boats and evaporated simultaneously to form the P-type photoconductive film. During vapour deposition, the currents flowing through respective boats are controlled such that the speed of vapour deposition of the first photoconductive substance is varied while that of the second photoconductive substance is maintained at a constant value so that the content of tellurium will be less than 10 atomic % at both interfaces of the P-type photoconductive film and a maximum concentration of 10 to 40 atomic % appears at a position near the N-type conductive film than at the central position inside the film, as shown in FIG. 1B.

Figure 2A:
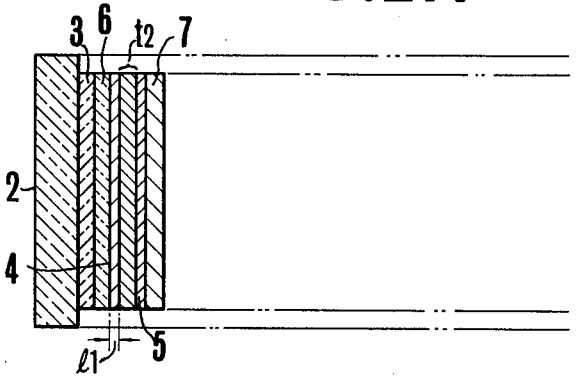
FIGS. 2A and 2A' are diagrammatic sectional views of the target structures embodying the invention.
Figure 2A:
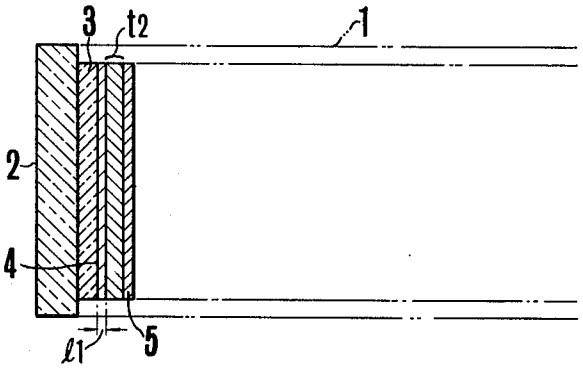

FIGS. 2A and 2A' diagrammatically show the construction of the targets of an image pickup tube embodying the invention, in which portions corresponding to those shown in FIGS. 1A and 1A' are designated by the same reference numerals.

Figure 2B:
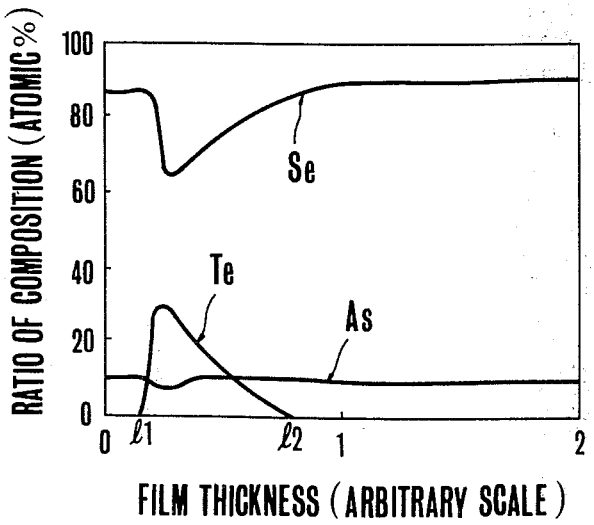
FIG. 2B is a graph showing the distribution of the composition of the P-type photoconductive film of the target structures shown in FIGS. 2A and 2A'.

FIGS. 2A and 2A' are different from FIGS. 1A and 1A' in that in FIGS. 2A and 2A', the region $t_2$ shows not only the high concentration region of the first photoconductive substance but also the thickness of the deposited layer of the first photoconductive substance, and that the region $t_2$ is not contiguous to the heterogeneous junction surface 4. More particularly, in the construction of the prior art target for use in the photoconductive image pickup tube the first photoconductive substance has been contained throughout the thickness of the P-type photoconductive film 5 and the high concentration portion of the substance was contiguous to the heterogeneous junction surface. As shown in FIG. 2B, in the target structure of this invention the first photoconductive substance concentrates at a portion having a particular thickness ($t_2 = l_2 - l_1$) of the P-type photoconductive film 5 and the initial point of the region $t_2$ is spaced by a distance $l_1$ from the heterogeneous junction surface 4. In other words, the layer consisting only of the second photoconductive substance is contained in the P-type photoconductive film 5 close to but spaced from the heterogeneous junction surface and at a region of more than $l_2$ thickness. When the distance $l_1$ is selected to be 80 – 1500 A and the region $t_2$ 500 to 5000 A, various advantages as will be described later will be obtained. In this case the thickness of the P-type photoconductive film 5 ranges from about 2 to 10 microns.

Figure 3:
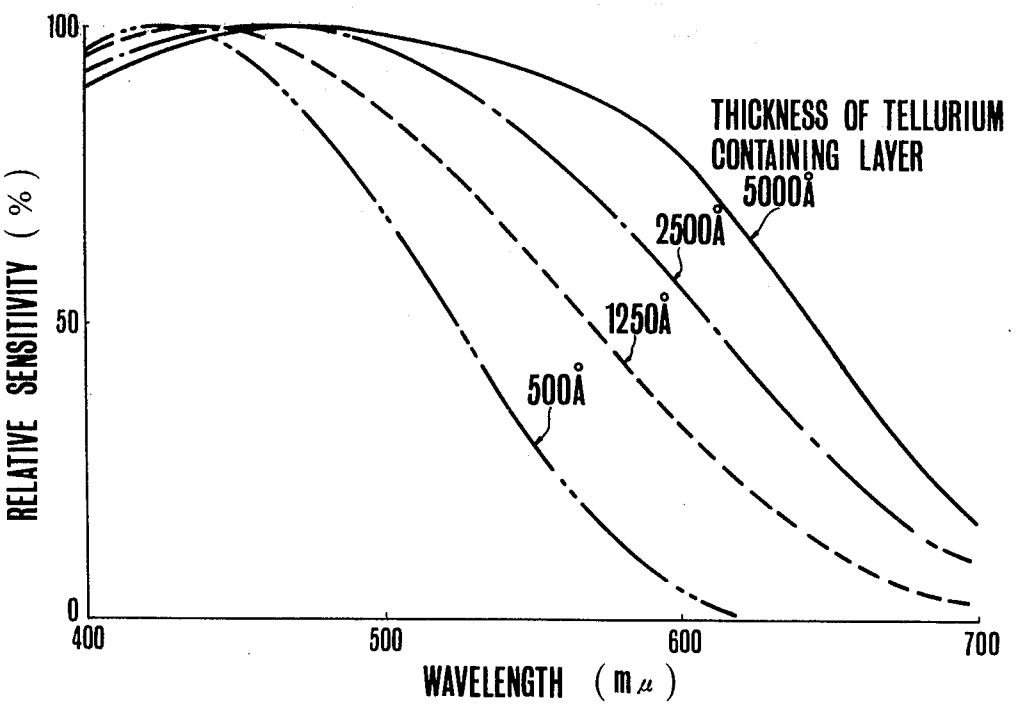
FIGS. 3 through 7 show various characteristics of a photoconductive image pickup tube utilizing the target structure embodying the invention.

FIG. 3 is a graph showing the relationship between the thickness $t_2$ of the layer containing tellurium in the P-type photoconductive layer and the relative sensitivity at a predetermined value of distance $l_1$. As can be noted from FIG. 3, where the thickness $t_2$ of the tellurium containing layer is equal to 500 A, the spectrum sensitivity characteristic decreases as the wavelength increases. When the thickness $t_2$ increases beyond 5000 A, the spectrum sensitivity is considerably high even in longer wavelength at near infrared waves.

Table 1 below shows the relationship between the thickness $t_2$ of the tellurium containing layer and the number of the picture defects in the form of white spots which are generated in the picked up picture. In this table the term "class of generated white spots" represents the number of the white spot defects in a unit area scanned in which A represents generation of 1 to 3 spots, B 4 to 7 spots, C 8 to 15 spots, numerous more than 16 spots.

Table 1

| Thickness of Te containing layer | Class of generated white spots | | | | |
|---|---|---|---|---|---|
| | None | A | B | C | Numerous |
| 5000A | 20% | 10% | 20% | 10% | 40% |
| 2500A | 67% | 11% | 11% | 11% | / |
| 1250A | 78% | 22% | / | / | / |

As this Table shows, as the thickness $t_2$ of the tellurium containing layer decreases the number of the white spots also decreases whereas when the thickness $t_2$ exceeds 5000 A, the number of the defects increases greatly, thus greatly impairing the quality of the image.

Considering an adequate thickness of the tellurium containing layer from FIG. 3 and Table 1, where the thickness is selected to be in a range of from 500 to 5000 A inclusive, the resulting target structure will have a relatively wide spectrum sensitivity region and produce lesser number of picture defects in the form of white spots.

On the other hand, when the thickness of the tellurium containing layer is within a range of from 1250 to 2500 A, it is possible to further improve the spectrum sensitivity characteristic and the defect of white spots.

The reason that the characteristics are improved in this manner is believed to be caused by the following factors. More particularly, incorporation of tellurium having a relatively narrow energy bandwidth (having a bandgap of 0.2 eV) into selenium having a relatively wide energy bandwidth (having a bandgap of 2.6 eV) results in a tellurium containing layer having a mean bandwidth of said two bandwidths. Narrower bandwidths improve the absorption of the light of longer wavelength along with a resultant high sensitivity of the image pickup tube so that considering only absorption of the light it would be advantageous to use layers consisting of tellurium alone. However, as tellurium has a strong tendency of crystallization, layers containing both tellurium and selenium are preferred. As the thickness of the tellurium containing layer increases, light absorption is enhanced. On the other hand, however, tellurium crystallizes greatly thereby increasing the number of the white spot defects generated. For this reason, in order to satisfy the two characteristics of light absorption and decreasing the tendency of crystallization, the above specified range of the thickness of the tellurium containing layer should be selected.

Figure 4:
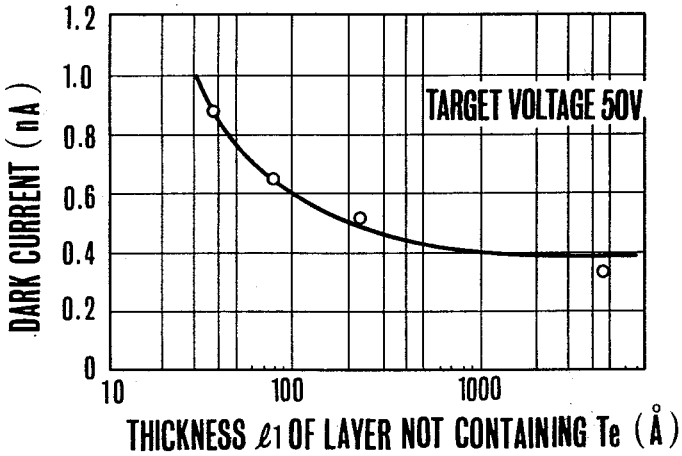

The relationship between the initial point of the tellurium containing layer and the distance of the P-type photoconductive film from the heterogeneous junction surface will now be considered. FIG. 4 shows the relationship between the magnitude of the dark current flowing through the target of a photoconductive image pickup tube for various values of the thickness of a layer $l_1$ formed at the initial stage of forming the P-type photoconductive layer and not yet containing tellurium. As FIG. 4 shows, when the layer $l_1$ not yet containing tellurium is formed beyond a point of 200 A, in other words when the starting point of the tellurium containing layer is spaced 200 A from the heterogeneous junction surface the dark current is very small and maintains a constant value, thus producing a target manifesting a dark current characteristic having a small and stable value. Practically, if the layer $l_1$ has a thickness of more than 80 A, a satisfactory target will be obtained.

Figure 5:
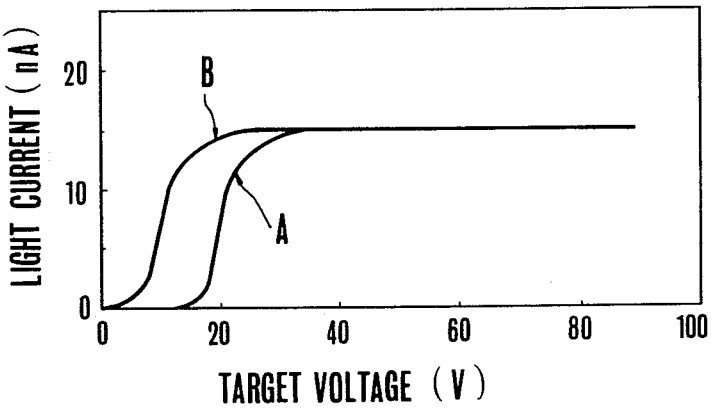

FIG. 5 is a graph showing the relationship between the target voltage and the variation in the light current characteristics when the target is irradiated with blue light of short wave, in which curve A represents a case wherein the thickness of the layer $l_1$ not containing tellurium is equal to 0 A (there is the tellurium containing layer contiguous to the heterogeneous junction surface) and curve B represents a case wherein the layer $l_1$ not containing tellurium has a thickness of 80 A. In both cases A and B the light current saturates as the target voltage (the voltage impressed upon the P-type photoconductive film through a terminal, not shown) increases. But in the case of B, as the thickness of the layer $l_1$ not containing tellurium increases, the saturation value of the target voltage is decreased. The higher is the saturation voltage the higher is the operating voltage of the image pickup tube thus rendering difficult to handle it. Moreover, the baking characteristic, one of the target characteristics, is degraded thus decreasing the picture quality. In other words, as the thickness of the layer $l_1$ not containing tellurium is increased (the case B), the characteristics of the image pickup tube are improved and the handling thereof is made easy.

Figure 6:
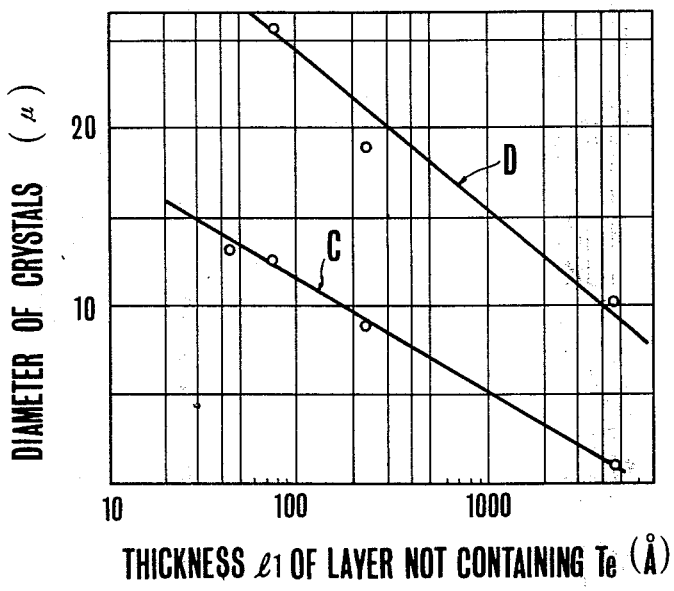

FIG. 6 shows the relationship between the thickness of the layer $l_1$ not containing tellurium and the diameter of the crystals formed at local points of the P-type photoconductive film, which is a measure for improving the thermal characteristic, wherein the temperature of the target was maintained at a definite value of 100° C for definite intervals (*c* represents 120 minutes and D 240 minutes). As can be noted from this figure, as the thickness of the layer $l_1$ not containing tellurium is increased, that is as the distance between the starting point of the tellurium containing layer and the heterogeneous junction surface increases the speed of growth of the crystals formed in certain local points of the P-type photoconductive layer slows down. In other words, as the thickness of the layer $l_1$ not containing tellurium increases, the tendency of crystallization is decreased whereby the thermal strength of the target is increased. Such crystallization of the film results in the local resistance variation of the film at the time of operation of the image pickup tube which creates the white spot defects. Accordingly, in order to improve the thermal characteristic, the thickness of the layer $l_1$ not containing tellurium should be increased. As has been pointed out hereinabove, in FIG. 6 the temperature of the target was maintained at 100° C but the actual operating temperature is less than 40° C in most cases. Generally speaking, each time the temperature varies 10° C, the speed of crystallization increases by a factor of 2 to 10. In any case, in order to improve the thermal characteristic, it is quite sufficient to provide a layer not containing tellurium of the thickness of at least more than 200 A. Practically, a layer not containing tellurium of the thickness of more than 80 A is satisfactory.

Figure 7:
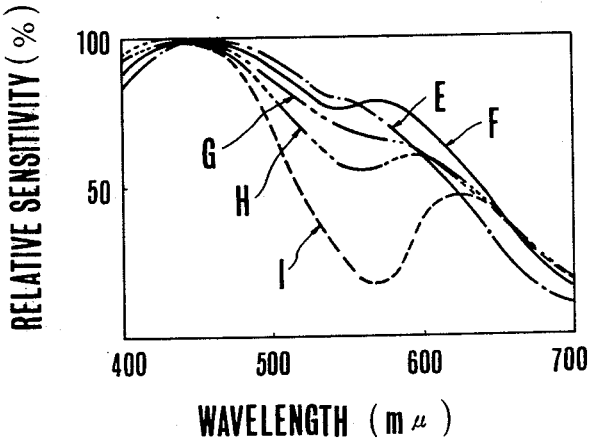

FIG. 7 is a graph showing the relationship between the relative spectral sensitivity of the target and the thickness of the layer $l_1$ not containing tellurium in which curve E represents the thickness of the layer $l_1$ of 80 A, curve F that of 220 A, G that of 1500 A, H that of 3000 A and I that of 7000 A. As can be noted from this figure if the layer $l_1$ not containing tellurium were too thick (in the cases H and I) abnormal spectral sensitivities would be resulted wherein high sensitivities are obtained on the sides of short wavelength and long wavelength in the visible range. Whether the image pickup tube is operated for monochromatic application or colour application, high spectral sensitivities are required over a wide range in the visible range. As the practical spectral sensitivities, those manifested by the layer $l_1$ having a thickness of at most 1500 A are desired.

The target structure of this invention can be manufactured as follows. In the conventional target structure for use in image pickup tubes since the tellurium containing layer is formed throughout the thickness of the P-type photoconductive layer 5 and the layer that does not contain tellurium is not formed, the first and second photoconductive substances are simultaneously vapour deposited from the time of starting vapour deposition until the entire thickness of the P-type photoconductive film 5 is completed. On the other hand, according to this invention as the thickness of the tellurium containing layer is limited to a specific value and as the layer $l_1$ not containing tellurium is formed, the vapour deposition of the first photoconductive substance is delayed than the time of commencing the vapour deposition of the second photoconductive substance. Moreover, the vapour deposition of the first photoconductive substance is terminated earlier than the termination of the deposition of the second photoconductive substance.

A glass substrate 2 in the form of the incident window of an image pickup tube is prepared and washed in a suitable cleaning liquid for the purpose of removing dust deposited on the glass substrate 2. The glass substrate is mounted in a bell jar of a well known vapour deposition apparatus with its cleaned surface faced upward. An N-type transparent conductive film comprising indium oxide or stannic oxide is vapour deposited on the glass substrate. By vapour depositing over a predetermined time under a suitable degree of vacuum and by suitably controlling the current flowing through a boat containing the material to be evaporated, a transparent conductive film having a predetermined thickness will be deposited on the glass substrate, the thickness ranging from 1200 A to 3600 A. Then the P-type photoconductive film 5 is deposited on the transparent conductive film to a predetermined thickness of from about 2 to 10 microns thereby forming the heterogeneous junction surface at the interface between the transparent conductive film and the P-type photoconductive film. As shown by FIG. 2B, as the second photoconductive substance containing 10 atomic % of arsenic is distributed substantially uniformly over the entire thickness of the P-type photoconductive film 5 the deposition is carried out at substantially constant speed. This can be accomplished by maintaining at a constant value the current supplied to a tantalum boat containing the second photoconductive substance to be evaporated as in a manner well known to the art. The first photoconductive substance consisting of selenium containing 40 atomic % of tellurium localizes at the portion of the P-type photoconductive film having a predetermined thickness so that the first photoconductive substance should be deposited at a continuously varying speed. To this end, the current supplied to the evaporation boat that contains pulverized first photoconductive substance is controlled suitably. Independent evaporation boats are used for containing the first and second photoconductive substances respectively.

As has been described hereinabove, according to this invention, for the purpose of producing the distribution of tellurium as shown in FIG. 2B, the vapour deposition time of the first photoconductive substance is delayed relative to that of the second photoconductive substance. To this end, the second photoconductive substance is firstly deposited on the transparent conductive film. This vapour deposition is continued until the P-type photoconductive film builds up to a predetermined thickness. Then, a predetermined time later, current is supplied to another evaporation boat containing the first photoconductive substance for commencing the vapour deposition thereof. When the tellurium containing film builds up to the predetermined thickness this deposition operation is terminated.

In this manner, a P-type photoconductive film containing a mixture of the first and second photoconductive substances is formed. For example, when the vapour deposition is commenced under a vacuum of $2 \times 10^{-6}$ Torr by supplying a current of 42 A to the evaporation boat containing the second photoconductive substance, if the time delay is selected to be from 10 to 60 seconds a layer not containing tellurium and having a thickness of 80 to 1500 A would be produced. A layer containing tellurium and having a thickness of 3000 A was obtained under these conditions by controlling the current supplied to the boat containing the first photoconductive substance for an interval of 130 seconds.

The target structure prepared in this manner is sealed to one end of the cylindrical glass envelope of an image pickup tube by using a metallic binder, for instance metallic indium, the metallic binder acting as an intermediate conductor to an external terminal.

In the illustrated embodiment, a P-type photoconductive film was formed on an N-type conductive film and an N-type semiconductive film was interposed between N-type conductive film and the P-type photoconductive film but it should be understood that the invention is by no means limited to such specific construction. Thus for example, where another N-type photoconductive film is formed, by specifying the beginning point of the tellurium containing layer with reference to the heterogeneous junction surface at the interface between the P-type photoconductive film and the another film, the same advantageous results can also be obtained, so that it is intended to include such modified construction also in the scope of the invention.

In the above description, a method of controlling the current supplied to a boat containing the first photoconductive substance has been shown for the purpose of localizing the same, but a shutter may be provided for the evaporation boat for the purpose of attaining the same object. The use of such shutter is also included in the scope of this invention.

As has been described hereinabove, in the target structure of the invention, a P-type photoconductive film containing selenium and a sensitizer such as tellurium is formed, the composition of the film is varied in the direction of the film thickness and the thickness of the tellurium or sensitizer containing film is limited to be in a range of from 500 A to 5000 A so that it is possible not only to select a relatively wide spectral sensitivity range but also to eliminate the white spot defect of the picture. Further, it is possible to improve such various characteristics as the dark current characteristic, the response speed characteristic, and the resolution characteristic. Moreover by setting the starting point of the tellurium containing layer to be in a range of 80 to 1500 A from the heterogeneous junction at the interface between the P-type photoconductive film and another film, it is possible to stabilize the dark current characteristic of the target structure, to prevent formation of the picture defects and to improve the spectral sensitivity characteristic.

While the invention has been described in its preferred embodiment, it is to be understood that the words which have been used are words of description rather than limitation and that changes within the purview of the appended claims may be made without departing from the scope and spirit of the invention in its broader aspects.

What is claimed is:

1. In a target structure for use in a photoconductive image pickup tube of the type comprising a transparent substrate, an N-type transparent conductive film deposited on the rear side of said substrate, and a P-type photoconductive film deposited on the rear side of said N-type transparent conductive film via heterogeneous junction surface and containing at least selenium and tellurium as an intensifier, the improvement wherein the thickness of the intensifier containing portion of said P-type photoconductive film is made to be within a predetermined range between 500 to 5000 A, said range smaller than the total thickness of said P-type photoconductive film and the starting point of said intensifier containing portion is positioned in a prescribed range of 80 to 1500 A as measured in the direction of thickness of said P-type photoconductive film from said heterogeneous junction surface between said P-type photoconductive film and said N-type conductive film.

2. The target structure according to claim 1 wherein said N-type transparent conductive film comprises indium oxide or mixture of indium oxide with stannic oxide.

3. The target structure according to claim 1 wherein said N-type transparent conductive film comprises stannic oxide or mixture of stannic oxide with antimony.

4. The target structure according to claim 1 wherein said P-type photoconductive film comprises a first photoconductive substance consisting of selenium containing tellurium and a second photoconductive substance consisting of selenium containing arsenic.

5. The target structure according to claim 4 wherein said P-type photoconductive film comprises selenium, less than 30 atomic % of tellurium and less than 30 atomic % arsenic.

6. The target structure according to claim 4 wherein the concentration distribution of said arsenic is substantially uniform over the entire thickness of said P-type photoconductive film.

7. The target structure according to claim 4 wherein the concentration of said tellurium localizes near said heterogeneous junction surface.

8. The target structure according to claim 1 wherein the thickness of said P-type photoconductive film ranges from about 2 to 10 microns.

9. The target structure according to claim 1 wherein a semiporous film is formed on the rear surface of said P-type photoconductive film.

10. The target structure according to claim 9 wherein said semiporous film comprises antimony trisulfide.

11. The target structure according to claim 1 which further comprises an N-type transparent semi-conductive film interposed between said N-type transparent conductive film and said P-type photoconductive film.

12. The target structure according to claim 11 wherein said N-type transparent semiconductive film comprises an element selected from the group consisting of cadmium selenide, cadmium sulfide, zinc sulfide, gallium silicate, germanium and silicon.

13. The target structure according to claim 11 wherein a semiporous film is formed on the rear surface of said P-type photoconductive film.

14. The target structure according to claim 13 wherein said semiporous film comprises antimony trisulfide.

* * * * *